US007169002B2

(12) United States Patent
Mizobe

(10) Patent No.: US 7,169,002 B2
(45) Date of Patent: Jan. 30, 2007

(54) METHOD OF MANUFACTURING A HIGH-PRESSURE DISCHARGE LAMP

(75) Inventor: Norimasa Mizobe, Shinagawa-ku (JP)

(73) Assignee: NEC Corporation, Tokyo (JP)

( * ) Notice: Subject to any disclaimer, the term of this patent is extended or adjusted under 35 U.S.C. 154(b) by 95 days.

(21) Appl. No.: 10/859,956

(22) Filed: Jun. 4, 2004

(65) Prior Publication Data

US 2005/0003729 A1 Jan. 6, 2005

(30) Foreign Application Priority Data

Jun. 6, 2003 (JP) ..... 2003-161832

(51) Int. Cl.
*H01J 9/00* (2006.01)
*H01J 9/14* (2006.01)

(52) U.S. Cl. ..... 445/22; 445/52; 445/29; 445/46

(58) Field of Classification Search ..... 445/22, 445/26, 27, 28, 32, 33, 35, 46; 140/71 R, 140/71.5, 71.6; 219/121.6, 121.61, 121.62, 219/121.63, 121.64
See application file for complete search history.

(56) References Cited

U.S. PATENT DOCUMENTS 4,942,331 A * 7/1990 Bergman et al. ..... 313/271
6,805,603 B2 * 10/2004 Kawamura et al. ..... 445/46
RE38,807 E * 10/2005 Takeuti et al. ..... 313/637

FOREIGN PATENT DOCUMENTS

| | | | |
|---|---|---|---|
| JP | 06-223783 A | | 8/1994 |
| JP | 10247478 A | * | 9/1998 |
| JP | 10-334789 A | | 12/1998 |
| WO | WO 2003058674 A1 | * | 7/2003 |

* cited by examiner

*Primary Examiner*—Mariceli Santiago
*Assistant Examiner*—Anne M Hines
(74) *Attorney, Agent, or Firm*—Sughrue Mion, PLLC

(57) ABSTRACT

For manufacturing a high-pressure discharge lamp, a tungsten electrode is welded to a molybdenum foil by bringing a shaft of tungsten electrode into close contact with the molybdenum foil, and by irradiating a laser light, having a metal melting wavelength, to a junction of the molybdenum foil with the tungsten electrode from a location closer to the molybdenum foil to melt both the molybdenum foil and the shaft of the tungsten electrode for bonding.

7 Claims, 4 Drawing Sheets

METHOD OF MANUFACTURING A HIGH-PRESSURE DISCHARGE LAMP

BACKGROUND OF THE INVENTION

1. Field of the Invention

The present invention relates to a method for manufacturing a high-pressure discharge lamp.

2. Description of the Related Art

General high-pressure discharge lamps such as an ultra high-pressure mercury lamp comprise an elongated cylindrical quartz glass tube which is comprised of a hollow spherical section, straight tube sections formed at both ends of the hollow spherical section, and electrode assemblies, each of which has an electrode that is partly embedded in an associated straight tube section and is opposite the electrode of the other electrode assembly in the spherical section. Each of the electrode assemblies has a molybdenum foil, a tungsten electrode shaft welded at one end of the molybdenum foil, and an external lead wire welded at the other end of the molybdenum foil. Then, the molybdenum foil, as well as part of the tungsten electrode and part of the external lead wire, welded at both ends of the molybdenum foil, are encapsulated in glass of the associated straight tube section. Mercury, an inert gas, and a halogen gas are enclosed in the space of the spherical section.

For welding the tungsten electrode shaft to the molybdenum foil, the tungsten electrode and molybdenum foil are sandwiched in layers between welding electrodes of a resistance welding machine, pressurized between the welding electrodes, and applied with a voltage for welding.

Another method of directly welding a tungsten electrode to a molybdenum foil, as mentioned above, involves forming a platinum thin film on a tungsten electrode shaft at which the molybdenum foil is welded, and resistively welding the platinum thin film to the molybdenum foil (see Paragraphs [0009] to [0011], and FIGS. 2 and 3 of JP-6-223783-A). Another method involves interposing a blazing member such as platinum, tantalum or the like between overlapping portions of a molybdenum foil and an internal lead wire which are scheduled to be welded, and performing plasma arc welding (see Paragraph [0038] and FIG. 3 of JP-10-334789-A). As described in the aforementioned JP-6-223783-A and JP-10-334789-A, a halogen lamp is generally manufactured by sandwiching a platinum foil between a molybdenum foil and a tungsten electrode, and melting the platinum foil during welding in order to weld the tungsten electrode to the molybdenum foil.

However, in the method of welding a tungsten electrode shaft to a molybdenum foil using a resistance welding machine, the tungsten electrode shaft can be bent, broken, or collapsed at a point applied with pressure, resulting in failure of the tungsten electrode itself, and eccentricity (see FIG. 1) of the electrodes which oppose each other within the lamp. In addition, even the application of pressure can be difficult for a tungsten electrode shaft having a small diameter.

Also, the melted tungsten electrode and molybdenum foil can stick to the welding rods (welding electrodes) of the resistance welding machine, and the welding rods can significantly wear out, so that frequent maintenance is required for the welding machine, making the welding process unsuitable for automatization.

Further, since the resistance welding encounters difficulties in the application of pressure to a small point, the molybdenum foil must be welded to the tungsten electrode over a wide area. Thus, when the molybdenum foil with the tungsten electrode welded thereto is sealed with glass, a large crack occurs in a portion of the glass sealed with the molybdenum foil, possibly resulting in defective air-tight sealing of the lamp due to the growth of the crack, and a bursting of the lamp when it is turned on.

Notably, the method of indirectly welding a tungsten electrode and a molybdenum foil with platinum or the like interposed therebetween, as described in the aforementioned JP-6-223783-A and JP-10-334789-A, entails an increased number of manufacturing steps and a higher cost.

SUMMARY OF THE INVENTION

It is an object of the present invention to provide a method of manufacturing a high-pressure discharge lamp (ultra high-pressure mercury lamp) which is capable of eliminating the disadvantages found in the resistance welding of a tungsten electrode to a molybdenum foil as described above, facilitating the welding of both, and improving the reliability of the resulting electric connection and the reliability of the lamp itself.

A high-pressure discharge lamp to which the manufacturing method of the present invention is applied includes a quartz glass tube made up of a spherical space and straight tube sections extending on both sides of the spherical space. An electrode assembly is sealed with glass of each straight tube section, and the two tungsten electrodes are disposed in the spherical space such that one end of one tungsten electrode opposes one end of the other tungsten electrode. A molybdenum foil overlaps with and is welded to the other end of each tungsten electrode. An external lead wire is welded to the end of each molybdenum foil opposite to the tungsten electrode. An inert gas containing mercury and a halogen gas is enclosed in the spherical space, the other ends of the tungsten electrodes and the molybdenum foils are embedded in glass of the respective straight tube sections, and the spherical space is hermetically sealed.

In the present invention, the tungsten electrode is welded to the molybdenum foil by bringing a shaft of each tungsten electrode into close contact with the molybdenum foil, and by irradiating a laser light having a metal melting wavelength to a junction of the molybdenum foil with the shaft of the tungsten electrode from a location closer to the molybdenum foil, and melting both the molybdenum foil and the shaft of the tungsten electrode for welding.

In the method of manufacturing a high-pressure discharge lamp, it is preferable to bring the molybdenum foil into close contact with the tungsten electrode over an angle ranging from zero to 120 degrees.

Also, it is preferable that the diameter of the laser light radiated from a location closer to the molybdenum foil is equal to or smaller than the diameter of the shaft of each tungsten electrode.

Further, the junction is irradiated with the laser such that laser irradiated points are arranged in a staggered pattern when the diameter of the radiated laser is smaller than the diameter of the shaft of the tungsten electrode and is equal to or larger than one-half of the diameter of the shaft of the tungsten electrode, and such that laser irradiated points are arranged in a staggered pattern or in a parallel pattern when the diameter of the radiated laser is smaller than one-half of the diameter of the shaft of the tungsten electrode.

It is preferable that the step of irradiating a laser light having a metal melting wavelength includes using a YAG laser.

The foregoing welding method can bond the tungsten electrode to the molybdenum foil with a smaller bonding area, unlike the conventional technique which involves sandwiching a tungsten electrode and a molybdenum foil in layers between welding electrodes of a resistance welding machine, thereby making it possible to reduce cracks which can occur in a portion of the glass sealed with the molybdenum foil.

In conventional resistance welding, electrode shafts can be bent or broken due to pressure applied thereto during welding when using tungsten electrodes that have shafts which are reduced in diameter. The present invention can eliminate such problems, and therefore avoid eccentricity between the electrodes of the lamp (see FIG. 1) due to bent electrode shafts.

In conventional resistance welding, the melted tungsten electrode and molybdenum foil stick to the welding rods of the resistance welding machine, and the welding rods significantly wear out, so that frequent maintenance is required for the welding machine, thus making the welding process unsuitable for automatization. The present invention, therefore, facilitates transition to automation.

When a laser is used, as in the present invention, both materials can be melted into a mixture, thus improving the reliability of the electrical connection and increasing the bonding strength.

Further, the present invention improves control of laser power and laser irradiated points, and can therefore reduce variations in welding strength.

The above and other objects, features and advantages of the present invention will become apparent from the following description with reference to the accompanying drawings which illustrate examples of the present invention.

DETAILED DESCRIPTION OF THE PREFERRED EMBODIMENTS OF THE INVENTION

Figure 1:
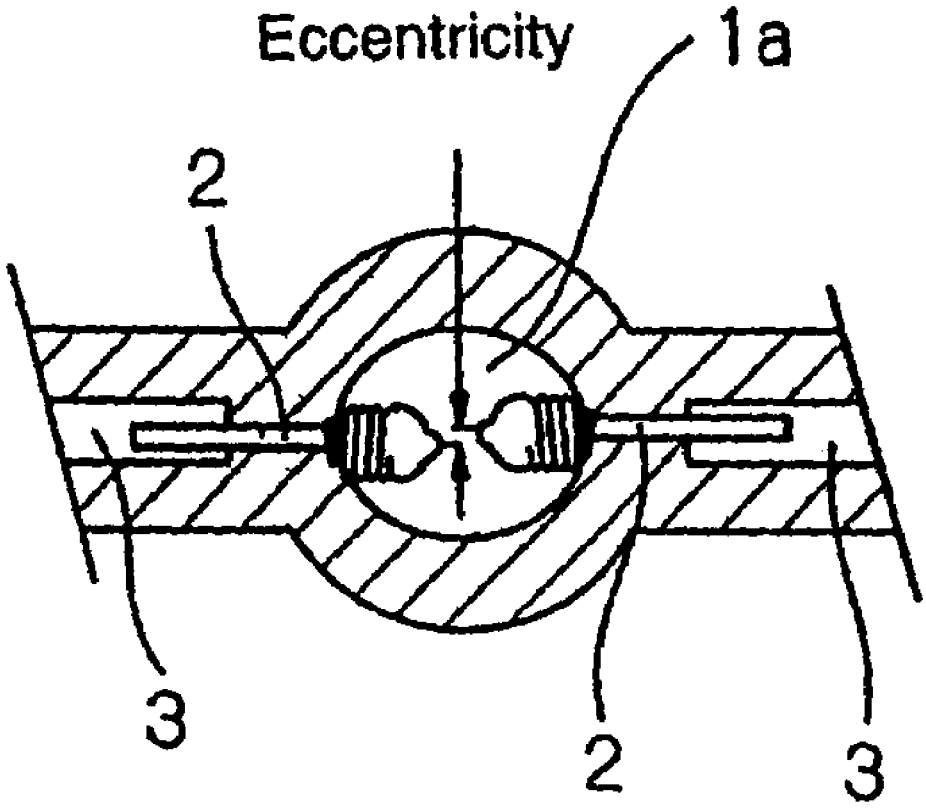
Fig. 1 (Prior Art)
FIG. 1 is a schematic cross-sectional view illustrating the eccentricity between electrodes which can occur during the conventional method of manufacturing a high-pressure discharge lamp.
Figure 2:
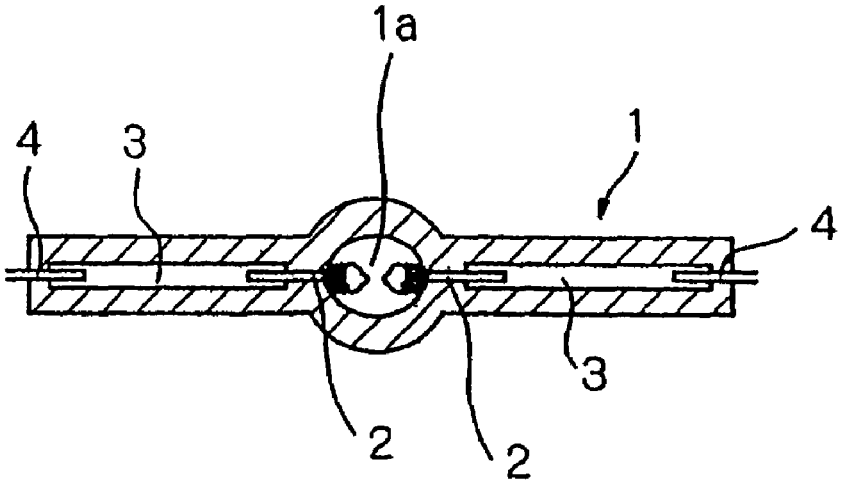
FIG. 2 is a schematic cross-sectional view illustrating the structure of a high-pressure discharge lamp to which the manufacturing method of the present invention is applied.

Referring first to FIG. 2, an ultra high-pressure mercury lamp, in one embodiment of the present invention, comprises lamp tube 1 made of quartz glass and having a central section formed in a spherical shape, and a pair of tungsten electrodes 2 arranged opposite to each other in central spherical space (discharge chamber) 1*a* of lamp tube 1. Each of tungsten electrodes 2 is connected to external lead wire 4 of a molybdenum rod through molybdenum foil (Mo foil) 3. Such an electrode assembly has part of tungsten electrode 1, molybdenum foil (Mo foil) 3, and part of external lead wire 4 sealed with quartz glass at one end of lamp tube 1. In this way, spherical space 1*a* of lamp tube 1 is hermetically sealed. While the illustrated lamp is intended for AC lighting, it can be used for DC lighting when an electrode functioning as an anode is made larger than an electrode functioning as a cathode.

Mercury, and an inert gas containing a halogen gas component are enclosed in spherical space 1*a*. For example, mercury is enclosed at 0.12 to 0.30 [mg/mm$^3$]. The inert gas may be a rare gas such as Ne (neon) or Ar (argon), and at least one of Cl (chlorine), Br (bromine), and I (iodine) is enclosed as a halogen gas, and a partial pressure of the halogen gas is adjusted in a range of $1\times10^{-8}$ to $1\times10^{-6}$ [μmol/mm$^3$]. Further, spherical space 1*a* is evacuated such that a partial pressure of oxygen within spherical space 1*a* reaches an ultimate pressure of $2.5\times10^{-3}$ [Pa] or lower. Here, the partial pressure of oxygen refers to the total of all partial pressures of oxygen containing gases such as $O_2$, CO, $CO_2$, $H_2O$, and the like, and can be measured by sampling gases within the fabricated high-pressure discharge lamp, and analyzing the sampled gases. In addition, it is preferable that the amount of enclosed inert gas is within a range of $6\times10^3$ [Pa] to $6\times10^4$ [Pa].

Tungsten electrode 2 used in the lamp is welded to or placed in press contact with molybdenum foil 3 such that tungsten electrode 2 remains electrically connected to molybdenum foil 3. Also, tungsten electrode 2 has a strength such that tungsten electrode 2 does not come off the junction with molybdenum foil 3 during processing steps until it is sealed with glass at each end of lamp tube 1 in the sealing step, and during handling and the like.

Figure 3:
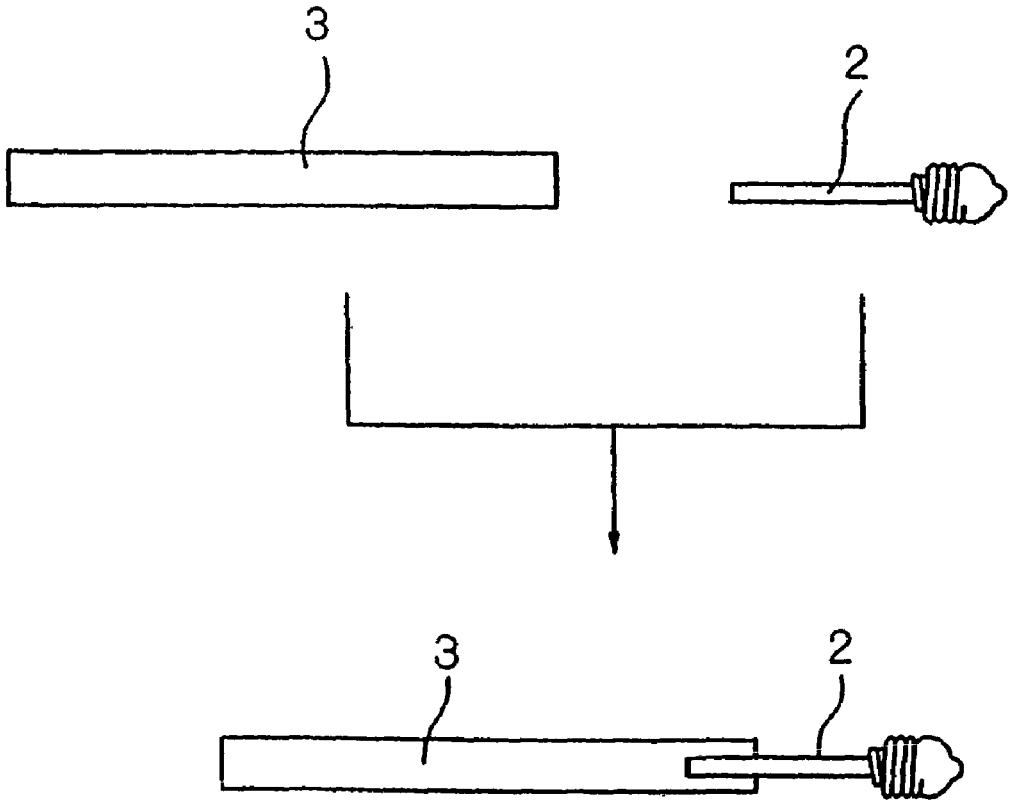
FIG. 3 is a schematic plan view illustrating how a molybdenum foil is bonded to a tungsten electrode, both shown in FIG. 2.
Figure 6:
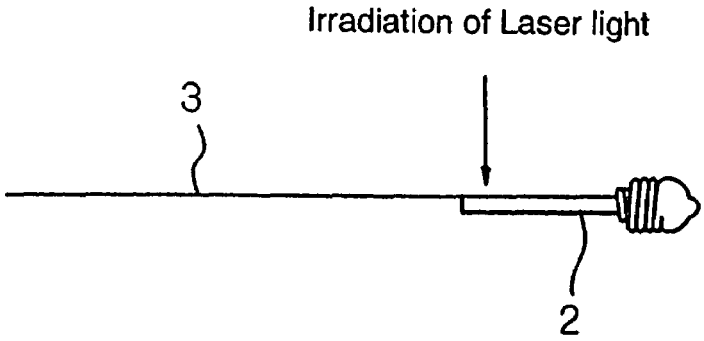
FIG. 6 is a lateral view illustrating how a laser is radiated to the tungsten electrode and molybdenum foil placed in close contact with each other based on the method of manufacturing a high-pressure discharge lamp in the present invention.

For example, when tungsten electrode 2 is welded to molybdenum foil 3, the shaft of molybdenum electrode 2 is brought into close contact with molybdenum foil (foil-shaped metal sealing material) 3 as illustrated in FIG. 3. Then, laser light is radiated from a location closer to molybdenum foil 3, as illustrated in FIG. 6, to melt both molybdenum foil 3 and tungsten electrode 2 for bonding. A laser used for the radiation of laser light may be one that has a metal melting wavelength, such as a YAG laser.

Figure 4:
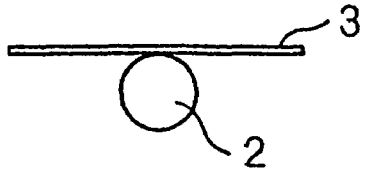
FIG. 4 is a schematic cross-sectional view showing a close contact angle (zero degree) when a molybdenum foil is brought into close contact with a tungsten electrode based on the method of manufacturing a high-pressure discharge lamp in the present invention.
Figure 5:
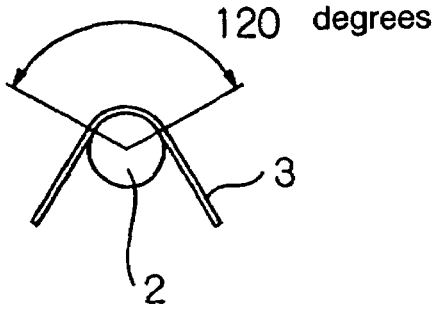
FIG. 5 is a schematic cross-sectional view showing a close contact angle (120 degrees) when the molybdenum foil is brought into close contact with the tungsten electrode based on the method of manufacturing a high-pressure discharge lamp in the present invention.

When molybdenum foil 3 is brought into close contact with tungsten electrode 2, the angle over which they are in close contact is chosen from zero degree (FIG. 4) to 120 degrees (FIG. 5).

Figure 7:
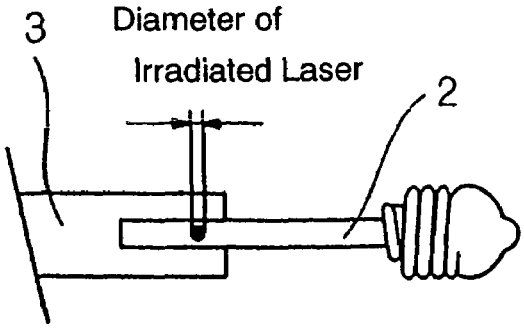
FIG. 7 is a plan view illustrating how a tungsten electrode is welded to a molybdenum foil with a laser radiated thereto based on the method of manufacturing a high-pressure discharge lamp in the present invention.

The laser light radiated from a location closer to molybdenum foil 3 is chosen in order to satisfy the condition that the laser light has a diameter equal to or larger than the diameter of the shaft of tungsten electrode 2 (FIG. 7).

Figure 8:
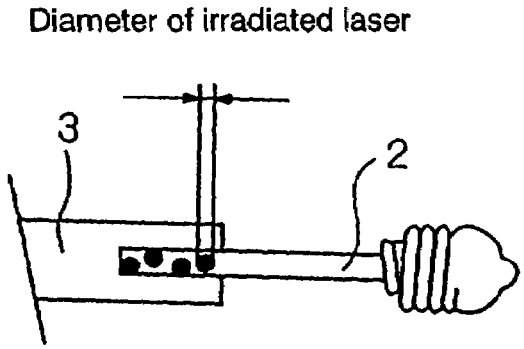
FIGS. 8 to 10 are diagrams for describing conditions which are applied when the tungsten electrode is welded to the molybdenum foil with a laser radiated thereto based on the method of manufacturing a high-pressure discharge lamp in the present invention.

When the diameter of the radiated laser is smaller than the diameter of the shaft of tungsten electrode 2 and is equal to or larger than one-half of the diameter of the shaft of tungsten electrode 2, laser irradiated points are arranged in a staggered pattern (FIG. 8).

Figure 9:
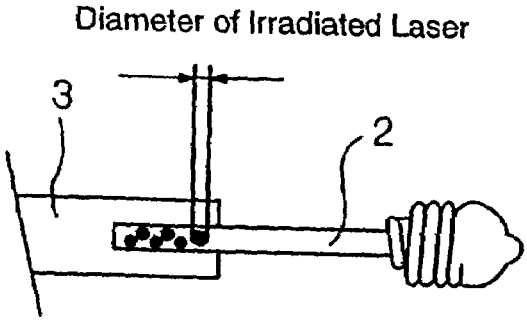
Figure 10:
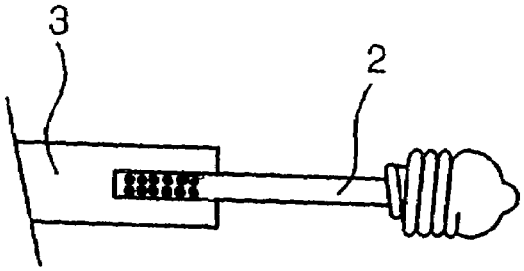

Alternatively, when the diameter of the radiated laser is smaller than one-half of the diameter of the shaft of tungsten 2, laser irradiated points are arranged in a staggered pattern (FIG. 9) or in a parallel pattern (FIG. 10).

The laser may be radiated in a continuous manner in order to leave laser irradiated lines as well as in a discrete manner in order to leave the laser irradiated points as illustrated.

The electrode assembly used in the high-pressure discharge lamp (ultra high-pressure mercury lamp) of the present invention has a tungsten electrode directly welded to one end of a molybdenum foil, and a molybdenum rod (external lead wire 4) welded to the other end of the molybdenum foil. The welding method in the foregoing embodiment can be applied as well to the welding of the molybdenum rod to the molybdenum foil.

Additionally, the high-pressure discharge lamp of the present invention will be described, as follows, giving specific values.

The high-pressure discharge lamp used in this embodiment was the ultra high-pressure mercury lamp (FIG. 2) in the foregoing structure.

The shaft of tungsten electrode 2 had a diameter of 0.3 mm to 0.5 mm, while molybdenum foil 3 had a width of 1.5 mm, a length of 12 to 20 mm, and a thickness of 10 to 20 μm.

Said tungsten electrode 2 and molybdenum foil 3 were brought into close contact with each other as illustrated in FIG. 3, and were irradiated with a laser from a location closer to molybdenum foil 3 as illustrated in FIG. 6 to weld tungsten electrode 2 to molybdenum foil 3. A YAG laser was used for the welding.

Figure 11:
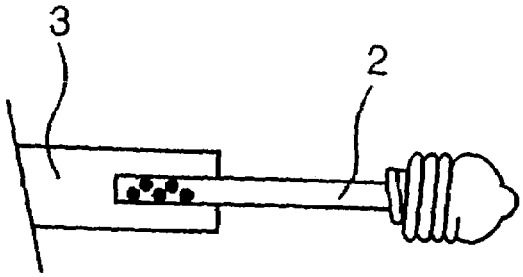
FIG. 11 is a diagram for describing conditions of implementation under which the tungsten electrode is welded to the molybdenum foil with a laser radiated thereto based on the method of manufacturing a high-pressure discharge lamp in the present invention.

The radiated laser in this event had a diameter of approximately 0.1 mm, so that the laser was radiated in a discrete manner in order to leave a total of five laser irradiated points arranged in a staggered pattern (FIG. 11).

While preferred embodiments of the present invention have been described using specific terms, such description is for illustrative purposes only, and it is to be understood that changes and variations may be made without departing from the spirit or scope of the following claims.

What is claimed is:

1. A method of manufacturing a high-pressure discharge lamp, said high-pressure discharge lamp having a quartz glass tube made up of a spherical space and straight tube sections extending from both sides of said spherical space; a pair of tungsten electrodes disposed in said spherical space such that one end of one tungsten electrode opposes one end of one tungsten electrode; a molybdenum foil overlapping with and welded to the other end of each of said tungsten electrodes; and an external lead wire welded to an end of each said molybdenum foil opposite to said tungsten electrode, wherein an inert gas containing mercury and a halogen gas is enclosed in said spherical space, the other ends of said tungsten electrodes and said molybdenum foils are embedded in glass of said respective straight tube sections, and said spherical space is hermetically sealed, said method comprising the steps of:

bringing a shaft of each said tungsten electrode into close contact with said molybdenum foil;

radiating a laser light, having a metal melting wavelength, onto a junction of said molybdenum foil with the shaft of each said tungsten electrode, from a location closer to said molybdenum foil; and melting both said molybdenum foil and the shaft of each said tungsten electrode for welding.

2. The method according to claim 1, wherein said molybdenum foil is brought into close contact with each said tungsten electrode over an angle ranging from zero to 120 degrees.

3. The method according to claim 1, wherein:

the diameter of the laser light radiated from a location closer to said molybdenum foil is equal to or smaller than the diameter of the shaft of each said tungsten electrode.

4. The method according to claim 1, wherein:

said junction is irradiated with the laser such that laser irradiated points are arranged in a staggered pattern when the diameter of the radiated laser is smaller than the diameter of the shaft of said tungsten electrode and is equal to or larger than one-half of the diameter the shaft of said tungsten electrode.

5. The method according to claim 1, wherein:

said junction is irradiated with the laser such that laser irradiated points are arranged in a staggered pattern when the diameter of the radiated laser is smaller than one-half of the diameter of the shaft of said tungsten electrode.

6. The method according to claim 1, wherein:

said junction is irradiated with the laser such that laser irradiated points are arranged in a parallel pattern when the diameter of the radiated laser is smaller than one-half of the diameter of the shaft of said tungsten electrode.

7. The method according to claim 1, wherein:

said step of radiating the laser light having a metal melting wavelength includes using a YAG laser.

* * * * *